US008931439B2

(12) United States Patent
Hemphill et al.

(10) Patent No.: US 8,931,439 B2
(45) Date of Patent: Jan. 13, 2015

(54) MODULE FOR CONTROLLING COOLANT VALVE AND GRILLE SHUTTER

(71) Applicant: Schaeffler Technologies AG & Co. KG, Herzogenaurach (DE)

(72) Inventors: Jeffrey Hemphill, Copley, OH (US); Philip George, Wooster, OH (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 14/081,440

(22) Filed: Nov. 15, 2013

(65) Prior Publication Data

US 2014/0137815 A1 May 22, 2014

Related U.S. Application Data

(60) Provisional application No. 61/727,281, filed on Nov. 16, 2012.

(51) Int. Cl.
*F01P 7/02* (2006.01)
*F01P 7/14* (2006.01)

(52) U.S. Cl.
CPC ..... *F01P 7/026* (2013.01)
USPC ..... 123/41.04; 123/41.08

(58) Field of Classification Search
USPC ..... 123/41.04–41.07, 41.08–41.1; 180/68.1
See application file for complete search history.

(56) References Cited

U.S. PATENT DOCUMENTS 1,500,418 A * 7/1924 Page et al. ..... 123/41.08
2010/0243352 A1 9/2010 Watanabe et al.
2011/0162595 A1 7/2011 Traudt

* cited by examiner

*Primary Examiner* — Noah Kamen
(74) *Attorney, Agent, or Firm* — Davidson, Davidson & Kappel, LLC

(57) ABSTRACT

A thermal management module includes a motor with an output shaft, and a gear train connecting the output shaft to a driven gear connected to a valve for controlling coolant flow in a coolant system. At least one grille shutter is movable between an open position allowing air through the grille shutter and a dosed position preventing air through the grille shutter. A linkage connects the at least one grille shutter to the output shaft or the gear train, so that the motor is operable to control a valve operating position of the valve and a shutter operating position of the at least one shutter.

13 Claims, 5 Drawing Sheets

MODULE FOR CONTROLLING COOLANT VALVE AND GRILLE SHUTTER

FIELD OF INVENTION

The present invention relates to a thermal management module of a cooling system of an internal combustion engine that controls both coolant flow within the cooling system and air flow.

DESCRIPTION OF THE PRIOR ART

US 2011/0162595 is an example of a heat management module for a cooling system of an internal combustion engine. This reference discloses switching between two coolant circuits. A bypass circuit returns coolant to the internal combustion engine and a radiator circuit directs to coolant through the radiator. The coolant flow is directed to either one or both of circuits by specific distribution to adjust the internal combustion engine to an optimum coolant temperature.

US 2010/0243352 discloses a further type of heat management for a motor vehicle referred to as active grill shutters (AGS). According to this reference, a plurality of louvers or shutters is disposed on the motor vehicle to control air flow through a front grille opening into an engine compartment. The AGS system allows airflow through the grille when demand on the cooling system or air conditioning is high. In addition, the active grille shutters may also be activated at higher speeds to reduce drag.

To utilize both the heat management module and the AGS system in a vehicle, two separate motors, cabling, and power electronics must be added to vehicles that are already complex and crowded.

SUMMARY OF THE INVENTION

An object of the present invention is to provide a heat management module and an AGS system while minimizing the installation space, mass, and cost.

The object of the present invention is met by a thermal management module comprising a motor having an output shaft, a gear train connecting the output shaft to a driven gear connected to a valve for controlling coolant flow in a coolant system, at least one grille shutter movable between an open position allowing air through the grille shutter and a closed position preventing air through the grille shutter, and a linkage connecting the at least one grille shutter to at least one of the output shaft and the gear train, so that the motor is operable to control a valve operating position of the valve and a shutter operating position of the at least one shutter.

According to an embodiment of the invention, the year train is an existing gear train for a Thermal Management Module that is adapted to control an AGS system. The existing gear train includes a worm gear meshed with a driven gear connected to drive the valve. An extension of the worm gear shaft is added and is operatively connected to drive the linkage, which comprises a crank driven to rotation by the extension. The crank is connected to the extension by a one way clutch so that a clockwise rotation causes the crank to rotate and a counter clockwise rotation causes the one way clutch to freewheel. Instead of an existing gear train, the module may include another gear train optimized for driving both a Thermal Management Module valve and shutters of an AGS system. Instead of a worm gear, such module may alternatively use a pinion gear.

A gear ratio of the worm gear or pinion gear rotation to the driven gear is configured so that multiple rotations of the worm gear or the pinion gear are required to move the valve from an open valve position to a closed valve position. The grille shutter cycles between the open shutter position and the closed shutter position during each of the multiple rotations. As an alternative, a different gear ratio between the grille shutter cycles and worm gear or pinion gear may be used. However, the ratio of the grill shutter cycle to the valve stroke should be relatively large such that small adjustments can be made to the grille shutter operating position with minimal changes to the valve operating position.

According to another embodiment, a controller is operatively connected to the motor to control the valve operating position and the shutter operating position. A latching mechanism includes a spring with a tab, and a protrusion on the crank that interacts with the tab during each cycle of the crank. During each rotation of the crank, the interaction of the tab and the protrusion causes an increase in electric power drawn by the motor that is sensed by the controller. The controller uses this cyclical power increase to determine the point at which the tab releases the crank and thus determine a position of the crank and the shutter.

Instead of the latching mechanism, a sensor may alternatively be used to monitor the crank position.

Instead of using the one way clutch, a clutch may be configured to selectively connect the motor output shaft to the linkage and the gear train. According to one embodiment, a solenoid acts on one of the motor output shaft and the clutch, such that the clutch connected to drive the gear train when the solenoid is not actuated and the clutch is connected to drive the linkage when the solenoid is actuated. In a preferred embodiment, the solenoid is actuated when it is energized. However, the solenoid may alternatively be de-energized to actuate.

BRIEF DESCRIPTION OF THE DRAWINGS

In the drawings, wherein like references denote similar elements throughout the several views.

DETAILED DESCRIPTION OF THE PREFERRED EMBODIMENTS

Figure 1A:
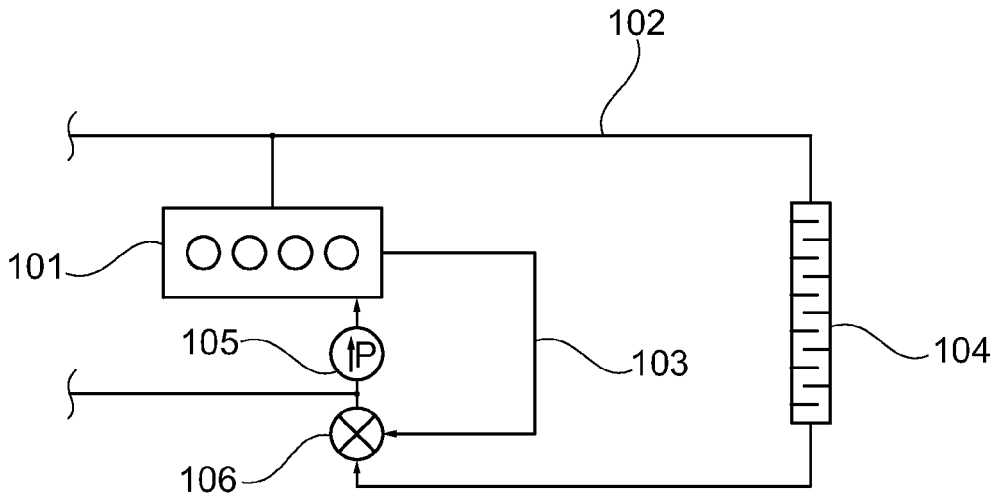
FIG. 1A is a schematic diagram of a cooling system for an internal combustion engine with a thermal management module.

FIG. 1A shows a cooling system for an internal combustion engine (ICE) 101 that includes a radiator circuit 102 and a bypass circuit 103. The radiator circuit 102 conducts fluid that has been heated by the ICE 101 to a radiator 104, which cools the fluid. The fluid is returned to the ICE 101 by a pump 105. The bypass circuit 103 is used to heat up the ICE 101 by bypassing the radiator 104. A heat management module 106 receives feeds from both the radiator circuit 102 and the bypass circuit 103 and outputs fluid from the radiator circuit 102, the bypass circuit 103, or a mixture thereof to the ICE 101.

Figure 1B:
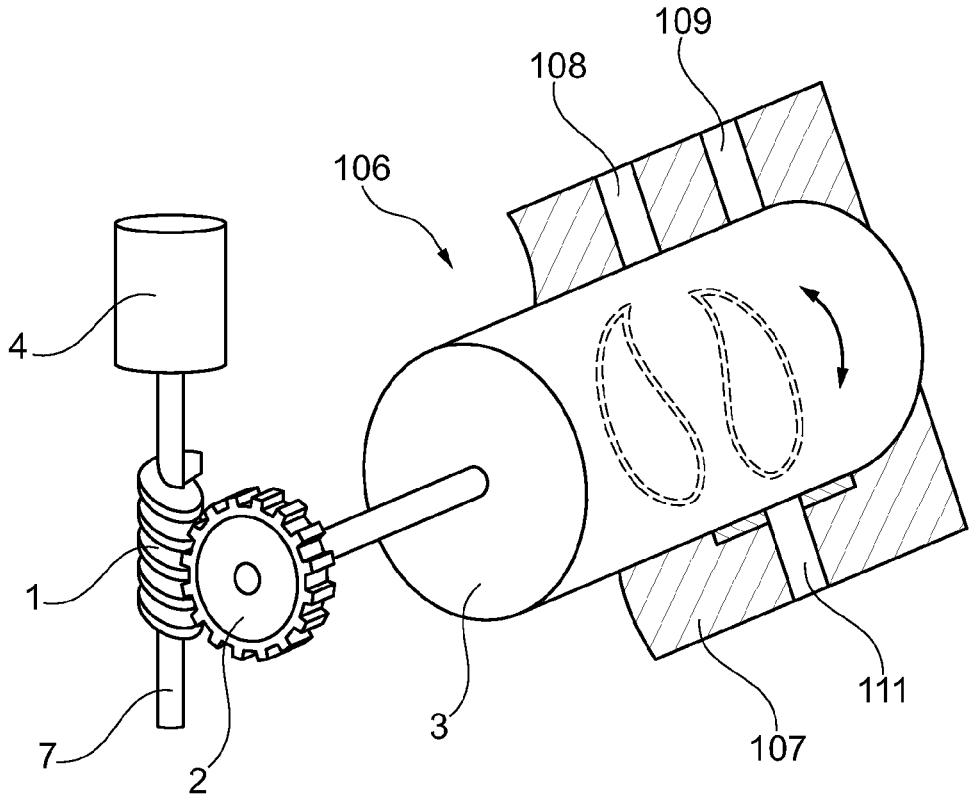
FIG. 1B is a schematic perspective view of the thermal management module of FIG. 1A.

FIG. 1B shows that the heat management module 106 includes a valve housing 107 having a first feed connection 108 receiving fluid from the bypass circuit 103 and a second feed connection 109 receiving fluid from the radiator circuit 102. Depending on the position of valve member 3, the first and second feed connections 108, 109 are selectively connected to discharge connection 111, which is connected to the ICE 101.

Figure 2:
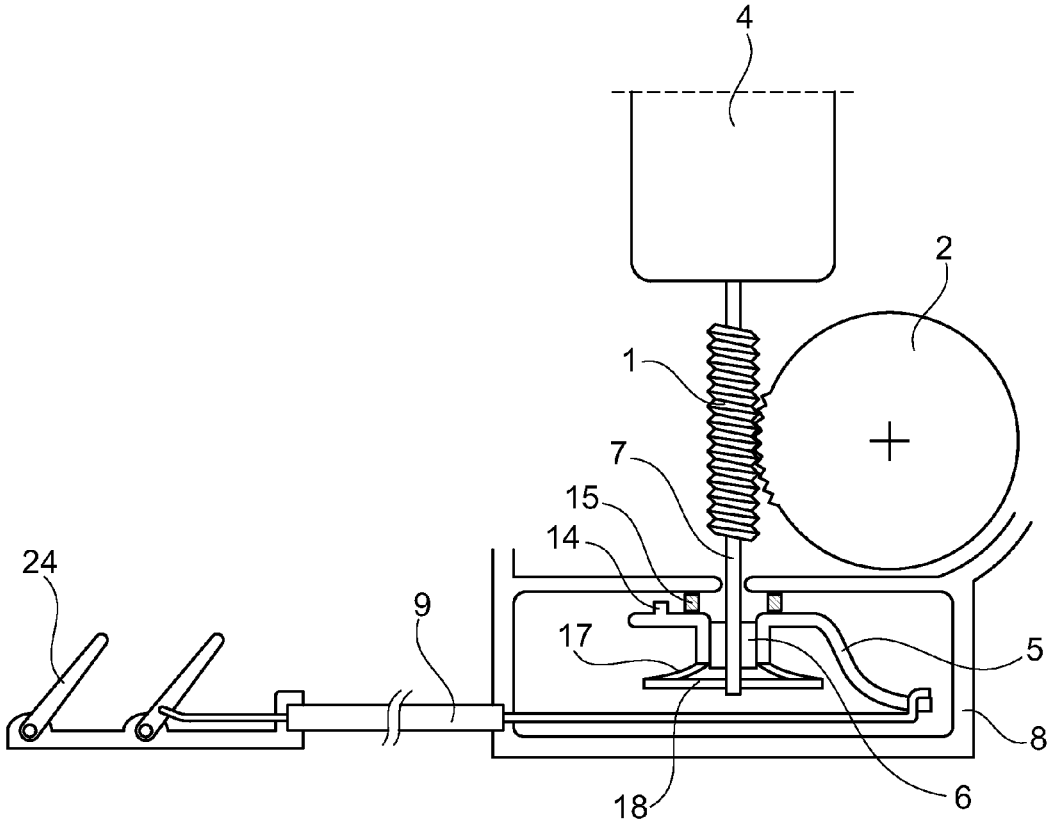
FIG. 2 is a schematic diagram showing the thermal management module according to an embodiment of the present invention.

FIGS. 1B and 2 show that the heat management module includes a motor driven worm gear 1 connected to a driven gear 2 of the valve member 3. The valve member 3 offers the ability to control coolant flow to the radiator and ICE as described above, and may additionally or alternatively control flow to a heater, and/or a turbo charger, to enable faster warmup of the engine and transmission and improving fuel economy. A shaft 7 of the worm gear 1 is driven by a motor 4 to control the position or the valve member 3.

Figure 3A:
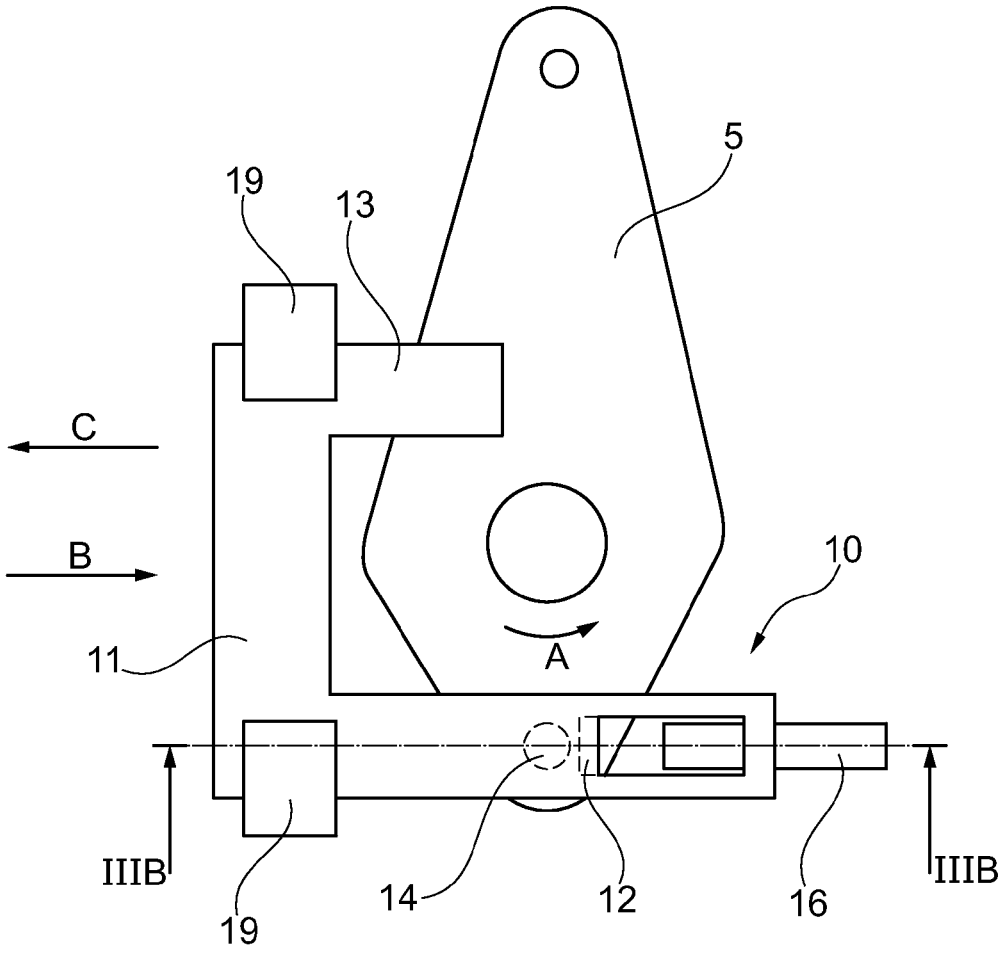
FIG. 3A is a top view of a latching mechanism according to an embodiment of the present invention.
Figure 4:
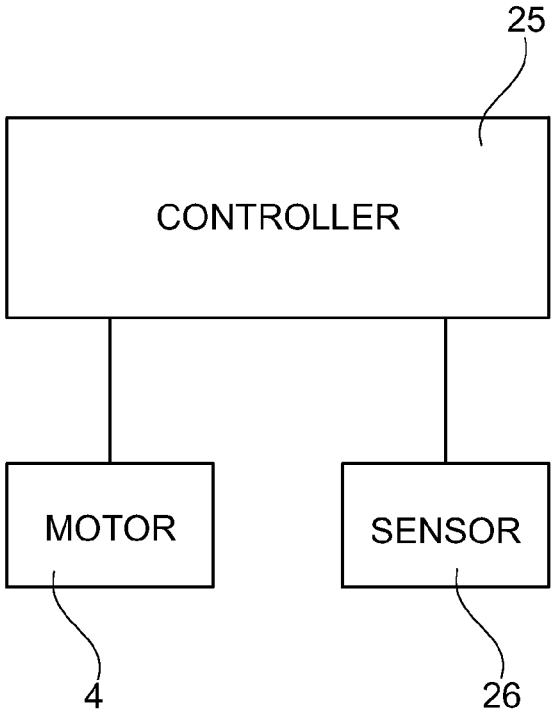
FIG. 4 is a block diagram of an embodiment of the present invention.

As shown in FIG. 2, the shaft 7 of the worm gear is also connected to a crank 5 by a one-way clutch (OWC) 6. The worm gear shaft 7 drives the crank 5 in only one direction (see the arrow A in FIG. 3A) via the OWC 6. As explained in more detail below, the crank 5 is connected by a linkage to an active grille shutter (AGS) system. Thus, the motor 4 is used to operate both the valve member 3 and the AGS system, A controller 25 is operatively connected to the motor 4 to control the position of the valve member 3 and of the AGS system (see also FIG. 4). When the controller 25 controls the motor 4 to rotate the worm shaft clockwise (ref. FIG. 3A), the OWC 6 is in freewheel mode and the crank 5 does not rotate. The crank 5 is maintained in position to hold the AGS system at a constant position during the freewheel mode by a friction washer 15 disposed between the crank 5 and a housing 8. A spring 17, such as a plate spring, is mounted between the crank 5 and a stop disk 18 arranged on the shaft 7 to urge the crank 5 against the friction washer 15. The crank 5 is connected to at least one shutter 24 of the AGS system by a cable 9, i.e., a Bowden cable. While the preferred embodiment includes the cable 9, a plastic rod or any other known or hereafter developed linkage may alternatively be used to connect the crank 5 to the AGS system. When controller 25 controls the motor 4 to rotate the worm shaft 7 counter clockwise, the OWC 6 is engaged and the crank 5 is rotated and the linkage cable 9 is moved to change the position of the AGS shutter 24 that is moved between an open shutter position and a dosed shutter position.

In the embodiment shown, a gear ratio of the worm clear 1 to the driven gear 2 is configured so that the worm gear 1 rotates a plurality of times during movement of the valve member 3 from an open valve position to a closed valve position. Thus, when the worm shaft 1 is rotated counter clockwise the crank 5 creates a cyclic motion between the open shutter position and the dosed shutter position. To select independent positions of the valve member 3 and AGS shutters 24, the controller 25 operates the motor 4 so that the desired valve position is over shot during a counter clockwise rotation to the desired position of the AGS shutter 24, and is then rotated clockwise back to the desired valve position without further affecting the position of the AGS shutter 24. When the valve member 3 must be adjusted by a clockwise rotation, the controller 25 operates the motor 4 so that the valve member 3 is adjusted past the desired valve position by the change in AGS position desired. When the shaft 7 is rotated clockwise, the AGS position is adjusted. If no adjustment of the shutter position is required during a clockwise adjustment of the valve, the valve can simply be adjusted to the desired position.

A position error to the valve introduced by the adjustment of the AGS system is minimized by increasing the ratio between the worm gear 1 and the valve member 3. That is, a higher ratio requires the worm 1 and the crank 5 to rotate much more than the valve member 3. Thus, the AGS shutter 24 can be brought into position with minimal disturbance of the valve position. Also, the time required to achieve a desired AGS shutter position can be as high as several seconds without affecting temperatures. Therefore, the priority for position is valve position, with a follow up position control for the AGS shutters.

Figure 3B:
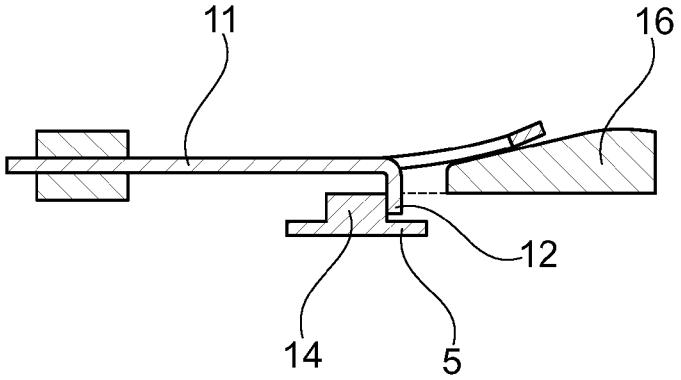
FIG. 3B is a side view of the latching mechanism according to FIG. 3A.

Because the OWC 6 is arranged between the crank 5 and the worm gear shaft 7, there is no fixed relationship between the crank 5 and the worm gear shaft 7. Therefore, it is desirable for the controller 25 to periodically determine a zero point, i.e., a fully closed point of the AGS shutter 24. This determination may be accomplished using a latching mechanism 10 as shown in FIGS. 3A and 3B, which includes a flat spring 11 with a tab 12 and a friction interface between the flat spring 11 and the crank 5. The flat spring 11 is mounted so that is movable relative to a housing 8. Motion of the flat spring 11 is limited to a linear translation relative to the housing 8 by mounts 19. The friction interface may, for example, comprise a tab 13 resting with resilient force on the crank. A knob 14 on the crank 5 interfaces with tab 12 on the flat spring as follows. When the crank 5 rotates, the knob 14 strikes the tab 12 causing the flat spring 11 to move in the direction of arrow B in FIG. 3A until the spring contacts friction washer 15 and/or shaft 7. This contact stops the linear motion of the flat spring 11 and the rotation of the motor. At this point, power drawn by the motor will peak as described above, and the reference position relating to a specific position of the AGS shutters, can be stored in the controller 25.

As the flat spring 11 moves, a section of the flat spring 11 proximate the tab 12 slides up a ramp 16 and the tab 12 is raised relative to the knob 14. However, friction between the knob 14 and the tab 12 prevents the tab from clearing the knob 14. That is, even though the ramp pulls up on the tab 12, torque produced by the motor urges the knob 14 against the tab 12 and the frictional force therebetween prevents the tab from clearing the knob 14 (see, e.g., FIG. 3B). Once the reference point is recorded, the controller 25 turns off power to the motor momentarily, thereby removing the friction force between the tab 12 and the knob 14 and the tab 12 clears the knob 14.

Further rotation of the motor rotates the crank 5 until the knob 14 contacts the tab 13, pushing the flat spring 11 in the direction C (opposite the direction B) until the flat spring 11 returns to its original position. The AGS shutter position can be referenced in this way once per revolution of the crank 5. The controller 25 may rotate the crank 5 through one or more cycles periodically to ensure a proper position of the shutter 24. For example, the controller 25 may rotate the worm shaft 7 through one or more clockwise rotations after a predetermined period in which no adjustments are made to ensure that the shutter 24 is maintained in the proper position. After the one or more clockwise rotations, the shutter 24 is moved to the desired position and the shaft 7 is then rotated back to the desired position of the valve member 3 by counter clockwise revolutions.

Figure 3C:
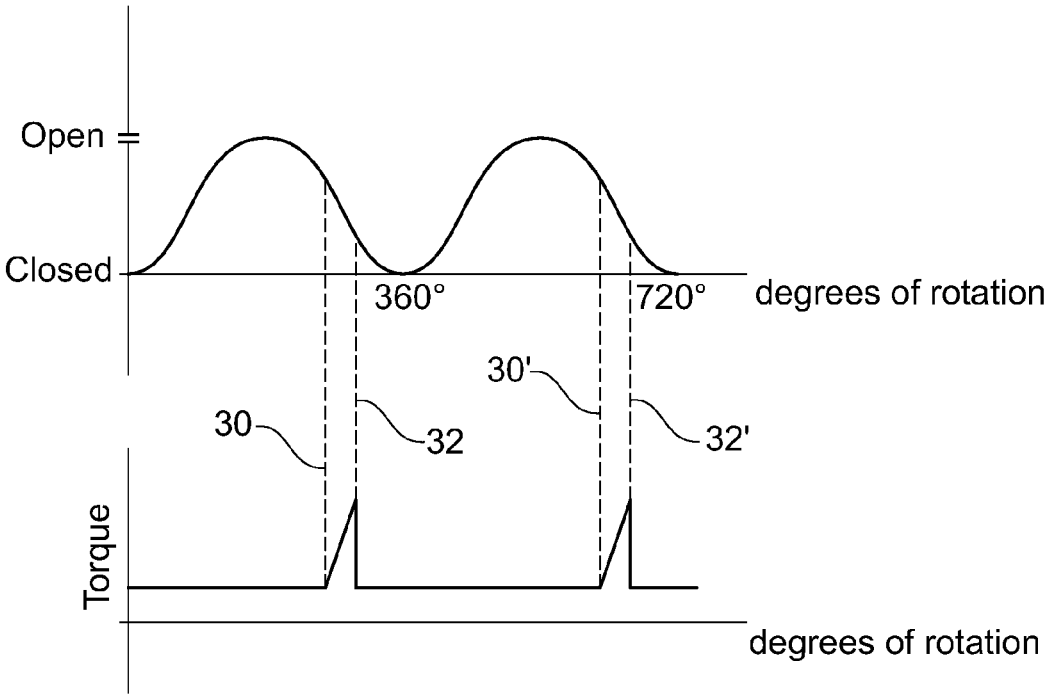
FIG. 3C is a graph illustrating the shutter position and the torque during two revolutions of the crank.

FIG. 3C shows a graph illustrating the shutter position and the torque during two revolutions of the crank. In the top part of the graph, the crank is rotated through two cycles from the closed position of the shutters to the open position of the shutters and back. The reference position is when the shutters are shut half way on the way to the closed position. The knob 14 first contacts the tab during rotation at point 30, 30'. Further rotation of the crank increases the torque required to move the crank until the spring motion stops when the flat spring 11 contacts the shaft 7 or the friction washer 15, i.e., at positions 32, 32'. The controller 25 will then associate the position of the worm gear shaft 7 with a half closed position of the shutters at points 32, 32'. Instead of using the flat spring 11, the latching mechanism may also be realized using a leaf spring or a coil spring.

The referencing function may be achieved in a variety of alternative ways. For example, an additional sensor 26 (see FIG. 4) may be used to monitor the crank position instead of the latching system 10. The sensor may, for example, be a rotary encoder or a hall effect sensor measuring rotation of the shaft 7 or a proximity sensor or infrared beam sensor monitoring a position of the crank 5.

Figure 5:
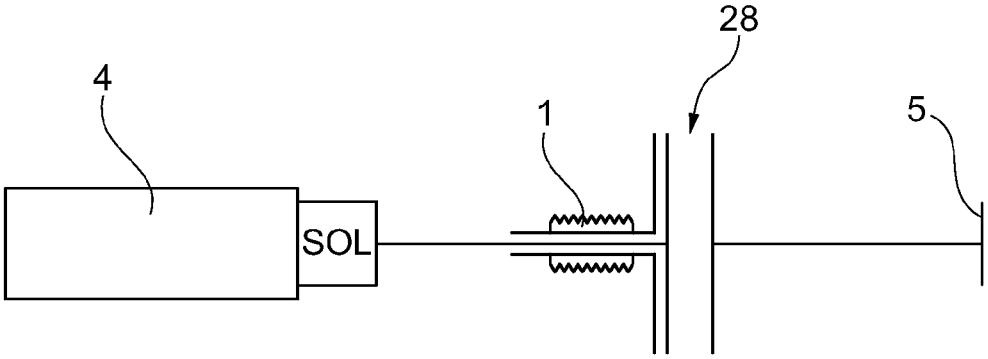
FIG. 5 is a schematic diagram of another embodiment of the present invention.

As an alternative to the OWC 6, a solenoid and small clutch could be used to selectively connect the motor 4 to the valve member 3 or the crank 5. FIG. 5 schematically shows a solenoid SOL operatively connected to an output shaft of motor 4. The output shaft is connected to a clutch 28 that is normally connected to the worm gear 1. When the solenoid SOL is energized the clutch 28 connects the output shaft to the crank 5 so that the shutter 24 can be adjusted. This embodiment would avoid the small errors in the valve position discussed above.

The present invention has been described with reference to a preferred embodiment. It should be understood that the scope of the present invention is defined by the claims and is not intended to be limited to the specific embodiment disclosed herein. For example, elements of specific embodiments may be used with other embodiments without deviating from the scope of the present invention.

What is claimed is:

1. A thermal management module of a motor vehicle, comprising:

a motor having an output shaft;

a valve for controlling a coolant flow in a cooling system;

a gear train connecting said output shaft to said valve;

at least one grille shutter movable between an open position allowing a flow of air through said grille shutter and a closed position blocking the flow of air through said grille shutter; and a linkage connecting said at least one grille shutter to at least one of said output shaft and said gear train, whereby said motor is operable to control a valve operating position of said valve and a shutter operating position of said at least one shutter.

2. The thermal management module of claim 1, wherein said gear train comprises a worm gear meshed with a driven gear connected to drive said valve.

3. The thermal management module of claim 2, wherein said worm gear has a worm gear shaft, and an extension of said worm gear shaft drives said linkage.

4. The thermal management module of claim 3, wherein said linkage comprises a crank driven to rotation by said extension.

5. The thermal management module of claim 4, wherein said crank is connected to said at least one of said output shaft and said gear train by a one way clutch.

6. The thermal management module of claim 2, wherein a gear ratio of said worm gear rotation to said driven gear is configured so that multiple rotations of said worm gear are required to move said valve from open to closed, and said grille shutter cycles between the open position and the closed position during each of said multiple rotations.

7. The thermal management module of claim 1, further comprising a controller operatively connected to said motor.

8. The thermal management module of claim 7, further comprising a latching mechanism comprising a spring with a tab, and a protrusion on said crank that interacts with said tab during each cycle of said crank, said interaction causing a change in power used by said motor that is sensed by said controller.

9. The thermal management module of claim 8, wherein the change in power corresponds to a specific position of said at least one grille shutter.

10. The thermal management module of claim 9, wherein the controller associates a position of the worm gear with the specific position of the grille shutter when the change in power occurs.

11. The thermal management module of claim 7, further comprising a sensor that monitors the crank position.

12. The thermal management module of claim 1, further comprising a clutch selectively connecting said motor output shaft to said linkage or said gear train.

13. The thermal management module of claim 12, further comprising a solenoid acting on one of said motor output shaft and said clutch, such that said clutch is connected to drive said gear train when said solenoid is not actuated and said clutch is connected to drive said linkage when said solenoid is actuated.

* * * * *